US005202037A

United States Patent [19]

Lavelle et al.

[11] Patent Number: 5,202,037

[45] Date of Patent: Apr. 13, 1993

[54] HIGH SOLIDS LUBRICANT

[75] Inventors: Grant E. Lavelle, Wood Haven; Charles Rossio, Carleton; Dwight Davis, Detroit, all of Mich.

[73] Assignee: Diversey Corporation, Mississauga, Canada

[21] Appl. No.: 416,149

[22] Filed: Oct. 2, 1989

[51] Int. Cl.[5] ..... C10M 173/00

[52] U.S. Cl. ..... 252/33.6; 252/49.3; 252/56 R; 252/42; 252/52 R

[58] Field of Search ..... 252/49.3, 33.6, 42, 252/52 R, 56 R

[56] References Cited

U.S. PATENT DOCUMENTS

| | | | |
|---|---|---|---|
| 3,023,163 | 2/1962 | Fucinari et al. | 252/49.3 |
| 3,583,914 | 6/1971 | Garvin et al. | 252/49.3 |
| 3,860,521 | 1/1975 | Aepli et al. | 252/49.3 |

*Primary Examiner*—Jacqueline Howard

*Attorney, Agent, or Firm*—Weintraub, DuRoss & Brady

[57] ABSTRACT

A high solids lubricant system suitable for use in aqueous lubricating systems is disclosed. The high solids lubricant first gels and then solubilizes in the aqueous lubricant stream. In a preferred embodiment, the aqueous stream further contains a water conditioning system.

11 Claims, No Drawings

HIGH SOLIDS LUBRICANT

BACKGROUND OF THE INVENTION

1. Field of the Invention

The subject invention relates to high solids lubricants for use in aqueous lubrication systems for machinery, particularly conveyor systems. These lubricants are advantageously used in conjunction with a water conditioning system.

2. Description of the Related Art

It is known to use aqueous base lubrication systems in transport machinery, for example, conveyor systems and the like. However, when attempts were made to increase the solids content of such lubricants, gellation, often irreversible, became a problem.

The gellation is due to the inability to control the viscosity of the lubricant. Excessive viscosities prevent the material from being delivered with conventional pumps, sprayers and the like.

It is well known that when fatty acid based aqueous lubricants are manufactured, the highest practical level of fatty acid which can be incorporated into the formulation is from about 20 to about 25 percent, by weight, of the concentrate from which the lubricant is prepared. Thereafter, for every part of fatty acid added to the formulation, two parts of a viscosity modifier must be added thereto. This, of course, creates needless cost increases in the product.

SUMMARY OF THE INVENTION

It has now been unexpectedly discovered that high solids lubricants suitable for use in aqueous systems, and which do not result in irreversible gellation may be prepared. These lubricants thus result in considerable economy with regard to shipping and handling. An additional benefit is provided when these high solids lubricants are used in conjunction with a water conditioning system to provide a complete lubrication system.

The present invention provides an organic based high solids lubricant concentrate which, generally, comprises:

(a) a fatty acid lubricant component;

(b) a neutralizing component;

(c) an organic viscosity control component; and (d) a nonionic surfactant.

The organic viscosity control component or agent is, preferably, a hydroxyl compound having from about 1 to 3 hydroxyl groups and includes alkanols, diols, triols and the like, as well as mixtures thereof. Because of the organic nature of the control agent, there is no build up in viscosity of the concentrate.

For a more complete understanding of the present invention reference is made to the following detailed description and accompanying examples.

DESCRIPTION OF THE PREFERRED EMBODIMENTS

The high solids lubricant concentrate of the subject invention comprises four components: a fatty acid lubricant component (a); a neutralizing component (b); a viscosity control component (c); and a nonionic surfactant component (d).

The fatty acid lubricant component (a) comprises a major portion of $C_9$ to $C_{20}$ fatty acids, and optionally a minor portion of a triglyceride oil. Any $C_9$ to $C_{20}$ fatty acid may be used, such as decanoic acid, dodecanoic acid, oleic acid, stearic acid, and the like. Preferably, the fatty acids are by-product fatty acids such as tall oil fatty acids. Optimally, a minor portion not exceeding approximately 40 weight percent of component (a) may be a fatty triglyceride oil, for example coconut oil, castor oil, and the like. The oil portion of component (a) is preferably less than 20 weight percent of component (a) and is most preferably approximately 10 to 15 weight percent. Component (a) is present in the high solids lubricant in an amount of from 50 to 70 weight percent, preferably about 60 weight percent.

Neutralizing component (b) comprises aqueous sodium or potassium hydroxide, particularly the latter, in conjunction with an organic primary or secondary amine. The neutralizing agent saponifies the fatty acid to render it amenable for dilution in aqueous media. Ordinarily, the mole ratio of amine to aqueous base ranges from 10:1 to about 1:10 but is preferably in the range of 3:1 to 1:3. By weight, the weight of amine to aqueous base is preferably from 4:1 to about 1:2. The organic amine may be any neutralizing amine, for example monoethanolamine, diethanolamine, ethylethanol amine, isopropanolamine, dipropylamine, and the like. Preferably, the amine will have a low vapor pressure, and thus the alkanol amines are preferred. Most preferred is monoethanolamine used in conjunction with aqueous potassium hydroxide in an amine to aqueous base weight ration of about 2–3:1. The neutralizer component is utilized in an amount of from 12 to about 22 percent by weight, preferably about 15 percent by weight.

It should further be noted that the aqueous base is, also, present as a water conditioning component for use in conjunction with a chelant, where the chelant is separately added, as hereinafter described.

The viscosity control component or agent is, generally, an alcohol, glycol or triol whose function is to lower the viscosity of the lubricant to a reasonable value suitable for low energy pumping or movement by pressure differential. Particular viscosity control agents may easily be selected by one skilled in the art according to routine measurements of viscosity, for example by using a Brookfield viscometer or similar device. Often, the effectiveness of the viscosity control agent may simply be assessed by visual observation of the resulting system. It is important that the control agent be compatible with the formulation. That is, the control agent should not cause the system to gel, solidify, or throw out significant precipitation. Preferred stabilizers include glycerine, propylene glycol, ethylene glycol, dipropylene glycol, diethylene glycol, ethanol, isopropanol, propanol, and the like, as well as DOWANOL® DPM, a dipropylene glycol. These control agents may also be used in mixtures. A particularly preferred mixture contains dipropylene glycol, isopropanol, and DOWANOL® DPM in a weight ratio of about 1:2:1. The viscosity control components are used in an amount of from 10 to 30, preferably about 20 percent by weight.

As hereinabove noted, because the present concentrates are organic compounds, there is no viscosity climb. In addition, glycols, where used, enhance the detergency properties of the resulting lubricant.

The nonionic surfactant must be capable of promoting a homogenous lubricant system. In this respect, one skilled in the art may prepare a system containing the remaining system components and add the surfactant incrementally while stirring. If a homogenous stable product results, then the surfactant is suitable for use in the high solids lubricants of the subject invention. Nonionic surfactants which are suitable may be found, for example, in the treatise *Nonionic Surfactants*, Martin Schick, Ed., Marcel Dekker.

Preferably, the nonionic surfactants are block, block heteric, or all heteric nonionic surfactants prepared by oxyalkylating a suitable mono- to tetrahydric initiation molecule with ethylene oxide, propylene oxide, butylene oxide, isobutylene oxide, or higher alkylene oxides such as those sold under the trade name VILCOLOX® ethylene oxides. Most preferably, the surfactant is a block surfactant containing polyoxyalkylene blocks derived from ethylene oxide and propylene oxide. Most preferred is a surfactant produced by BASF Corp. under the trade name PLURAFAC B-26 which is believed to be a linear alcohol alkoxylate having an average molecular weight of about 1030. The nonionic surfactant is used in an effective amount of up to about 20 percent by weight. Occasionally, a formulation may be stable in the absence of the surfactant.

The high solid lubricant of the subject invention are manufactured by adding the components (a) through (d) in the order given, generally, by slow addition coupled with agitation.

The high solids lubricants are, preferably, used in conjunction with a water conditioning system comprising a chelant and neutralizing base. The chelants useful are well known to those skilled in the art, and are generally polycarboxylic acids such a ethylenediamine tetraacetic acid (EDTA), citric acid, and nitrilotriacetic acid. The chelant is neutralized with an aqueous base, preferably aqueous 45 percent potassium hydroxide. When EDTA is used as the chelant, for example, it is generally formulated with aqueous KOH in a weight ratio of 80:20. This mixture may be diluted with water to the final concentration desired.

The present two component lubricating system is advantageously employed in conjunction with a delivery system such as that described in copending U.S. patent application Ser. No. 286,335, filed Dec. 19, 1988 for "Lubricant Delivery System", the disclosure of which is hereby incorporated by reference.

As described in the copending application, in use, the energy necessary to provide lubricant to the conveyor system or other machinery to be lubricated is supplied by a pump. Water conditioner is drawn from the water conditioner reservoir and delivered into the water stream upstream of the pump. The high solids lubricant is pumped into the exit stream from the pump or preferably is drawn by suction into the pump, and enters the lubricant stream through an injection nozzle. Upon contact with the aqueous stream gellation generally occurs. However, unlike prior high solids lube systems, the gellation is reversible. The solubilization of the gel may be accomplished in several ways, as described in the copending application.

Preferably, a reciprocating check valve deriving its energy of operation from the lubricant stream itself is used. The gel is finely subdivided by this method and solution effectuated during further transit towards the machinery to be lubricated. A further, less preferred method, is to introduce the gel into a cylinder of beads which causes the gel to shear. Alternatively, one or more static mixers may be used.

It should further be noted with respect hereto that other components or adjuvants may be incorporated into the high solids lubricant hereof. For example, anionic surfactants, such as the alkyl benzene sulfonates; other higher alkyl nonionic surfactants and the like. These adjuvants are incorporated in order to tailor the properties of the lubricant.

It should, also, be noted that it is possible to prepare a one-component lubricant herefrom by incorporating the chelant directly into the formulation. Where this is done, then, the levels of fatty acid must be reduced to about 25 percent to about 50 percent of the total weight of the lubricant. Furthermore, where this is done, the order of addition of the components is changed to solubilize the fatty acid in the viscosity control agent and the chelant or sequestrant, with the hydroxide portion of the neutralizing agent being added prior to the fatty acid addition. Where the chelant is directly added to the lubricant it is present in an amount ranging from about 1 to about 15 weight percent.

For a more complete understanding of the present invention reference is made to the following detailed description and accompanying examples. In the examples, which are to be construed as illustrative rather than limitative of the present invention, all parts are by weight, absent contrary indications.

EXAMPLE I

This example illustrates the preparation of a high solids lubricant which is intended to be used as part of a two component system as described in the aforementioned copending application.

Into a suitable container equipped with agitation means were added the following ingredients in the order and amounts recited.

| Ingredient | Amount, pbw |
|---|---|
| Tall Oil Fatty Acid | 52.0 |
| Coconut Fatty Acid | 8.0 |
| Viscosity Control Agent 1[1] | 5.0 |
| Dipropylene Glycol | 5.0 |
| Monoethanolamine | 11.0 |
| Potassium Hydroxide (as a 45% Solution) | 4.8 |
| Surfactant A[2] | 5.0 |
| Isopropanol | 9.2 |

[1]a dipropylene glycol monomethyl ether sold commercially by Dow Chemical under the name DOWANOL DPM

[2]a linear alcohol alkoxylate sold commercially by BASF Corp. under the name PLURAFAC B-26

The lubricant had a final viscosity of about 150 cps as determined with a Brookfield viscometer at 25° C.

EXAMPLE II

Following the procedure of Example I, a high solids lubricant in accordance herewith was prepared by the sequential addition of the following components in the respective amounts.

| Ingredient | Amount, pbw |
|---|---|
| Tall Oil Fatty Acid | 45.0 |
| Coconut Oil Fatty Acid | 7.0 |
| Dipropylene Glycol | 10.0 |
| Propylene Glycol | 9.0 |
| Potassium Hydroxide (as a 45% solution) | 10.0 |
| Monoethanolamine | 7.0 |
| Surfactant A[1] | 3.0 |
| Surfactant B[2] | 3.0 |

-continued

| Ingredient | Amount, pbw |
|---|---|
| Isopropanol | 6.0 |

(1)same as in Example I
(2)a nonyl phenol ethoxylate sold by GAF under the name IGEPAL CO-630.

This lubricant is efficacious when used as part of a two component system, as described in Example I.

EXAMPLE III

Following the procedure of Example I, a high solids lubricant was prepared by the sequential addition of the following components in the recited amounts:

| Ingredient | Amount, pbw |
|---|---|
| Tall Oil Fatty Acid | 45.0 |
| Coconut Fatty Acid | 7.0 |
| Dipropylene Glycol | 10.0 |
| Propylene Glycol | 10.0 |
| Surfactant C(1) | 2.0 |
| Potassium Hydroxide (as a 45% solution) | 10.0 |
| Monoethanolamine | 7.0 |
| Surfactant A(2) | 3.0 |
| Isopropanol | 6.0 |

(1)an anionic surfactant which is a sodium naphthalene sulfonate sold under the name PETROL BA Petrol Chemical Co. and is used to enhance detergency.
(2)same as Example I Again, and as in Example I, this lubricant is intended to be used as part of a two component lubricant system.

EXAMPLE IV

This example illustrates the preparation of a one component high solids lubricant in accordance with the present invention.

Into a suitable container equipped with agitation means, the ingredients were sequentially added with stirring, and at room temperature, in the amounts set forth.

| Ingredient | Amount, pbw |
|---|---|
| Dipropylene Glycol | 11.0 |
| Propylene Glycol | 12.0 |
| EDTA(1) | 3.5 |
| Potassium Hydroxide (as a 45% solution) | 13.0 |
| Tall Oil Fatty Acid | 35.0 |
| Coconut Fatty Acid | 10.0 |
| Monoethanolamine | 7.5 |
| Surfactant A(2) | 4.0 |
| Surfactant B(3) | 4.0 |

(1)a 50% solution of EDTA
(2)same as Example I
(3)a lauryl amine oxide surfactant, for increasing foaming, sold commercially under the name AMMOYX LO by Onyx Chemical.

The resulting lubricant has a viscosity of about 100 cps as determined with a Brookfield viscometer at 25° C. This one component lubricant is intended for use in soft water conditions and will maintain a clear solution, free from precipitated calcium soaps in 20 ppm hard water at a concentration of 1:400, and will not gel on dilution with water.

EXAMPLE V

Following the procedure of Example IV a one component high solids lubricant was prepared from the sequential addition of the following components in the recited amounts:

| Ingredient | Amount, pbw |
|---|---|
| Dipropylene Glycol | 11.0 |
| Propylene Glycol | 12.0 |
| EDTA(1) | 7.0 |
| Potassium Hydroxide (as a 45% solution) | 24.0 |
| Tall Oil Fatty Acid | 25.0 |
| Coconut Fatty Acid | 10.0 |
| Monoethanolamine | 3.0 |
| Surfactant A(2) | 8.0 |

(1)same as in Example IV
(2)same as in Example I

The viscosity of this lubricant was observed to be about 125 cps as determined with a Brookfield viscometer at 25° C.

Having, thus, described the invention, what is claimed is:

1. A high solids lubricant composition suitable for use in an aqueous lubrication system, consisting essentially of:
   (a) from about 25 percent to about 70 percent by weight, based on the total composition weight, of a fatty acid lubricant component comprising one or more $C_9$ to $C_{20}$ fatty acids;
   (b) from about 12 percent to about 22 percent by weight, based on the total composition weight, of a neutralizing component comprising:
      (1) a primary amine or a secondary amine; and
      (2) an alkali metal hydroxide;
   (c) from about 10 percent to about 30 percent by weight, based on the total composition weight, of a viscosity control agent selected from the group consisting of alcohols, glycols, triols, and mixtures thereof;
   (d) from about 1 percent to about 20 percent by weight, based on the total composition weight, of a nonionic surfactant, and
   (e) from about 0 percent to about 15 percent by weight, based on the total composition weight, of a chelant; and wherein the composition forms a gel in water, the gellation being reversible by the action of mechanical means.

2. The lubricant of claim 1 wherein the surfactant (d) is a linear alcohol alkoxylate.

3. The lubricant of claim 1 wherein said amine is an alkanolamine.

4. The lubricant of claim 3 wherein said alkanolamine is a monoalkanolamine.

5. The lubricant of claim 1 wherein:
   the viscosity control agent is a mixture of dipropylene glycol and dipropylene glycol monomethyl ether.

6. The lubricant of claim 1 wherein the composition consists essentially of:
   (a) from about 35 to about 70 percent, by weight, of the fatty acid based on the total weight of the composition;
   (b) from about 12 to about 22 percent, by weight, of the neutralizing agent based on the total weight of the composition;
   (c) from about 10 to about 30 percent, by weight, of the viscosity control agent based on the total weight of the composition;
   (d) from about 1 to about 20 percent, by weight, of the nonionic surfactant based on the total weight of the composition and (e) from about 1 to about 15 percent, by weight, of a chelant based on the total weight of the composition.

7. The lubricant of claim 1 wherein:

the chelant is ethylene diamine tetraacetic acid.

8. A process for providing an aqueous lubricant stream suitable for use in lubricating machinery, comprising:

a) adding the lubricant of claim 1 to an aqueous stream in such a manner as to cause gelation;

b) providing a means for finely dividing said gel in such a manner that the gel solubilizes in said aqueous stream;

c) introducing said gelled stream from (a) into said dividing means (b); and d) thereafter delivering said aqueous lubricant solution to machinery points in need of lubrication.

9. The process of claim 7 wherein said aqueous stream prior to the introduction of the lubricant of claim 1 contains a water conditioning system comprising the alkali metal salt of a polycarboxylic acid.

10. The process of claim 8 wherein said polycarboxylic acid is selected from the group consisting of ethylenediamine tetraacetic acid, nitrilotriacetic acid, and citric acid.

11. The high solids lubricant of claim 1 wherein the fatty acid lubricant component is present in an amount from in excess of 30 percent to about 70 percent by weight based on the total weight of the composition.

* * * * *